United States Patent [19]

Puccetti et al.

[11] 4,079,662

[45] Mar. 21, 1978

[54] BAG MAKING MACHINE

[75] Inventors: Ralph P. Puccetti, Oak Park; King L. Klopfenstein, Prospect Heights, both of Ill.

[73] Assignee: Triangle Package Machinery Company, Chicago, Ill.

[21] Appl. No.: 746,094

[22] Filed: Nov. 30, 1976

[51] Int. Cl.[2] ..... B31B 33/00

[52] U.S. Cl. ..... 93/14; 53/182 R; 93/19

[58] Field of Search ..... 53/28, 182 R; 93/8 R, 93/14, 18–20, 26, 27, 33 H, 35 SB

[56] References Cited

U.S. PATENT DOCUMENTS

| | | | |
|---|---|---|---|
| 3,091,902 | 6/1963 | Reinhardt et al. | 53/28 |
| 3,326,097 | 6/1967 | Lokey | 53/28 X |
| 3,552,081 | 1/1971 | Leasure | 53/28 |
| 3,774,509 | 11/1973 | Heinzer | 93/35 SB X |
| 3,785,112 | 1/1974 | Leasure et al. | 53/28 |

*Primary Examiner*—James F. Coan

*Attorney, Agent, or Firm*—Emrich, Root, O'Keeffe & Lee

[57] ABSTRACT

A bag making machine for making bags from a sealable film is disclosed wherein the film is fed over a forming shoulder and around a forming tube. Sealer jaws form a transverse seal to provide a top for one bag and the bottom of the next adjacent bag, and move with the film as it is advanced intermittently along the tube. Separate and independent means are provided to advance the film simultaneously with movement of the sealer jaws, and means are also provided for forming a substantially flat bottom on each bag including a novel arrangement of folding plates for the bottom, tuckers for forming gussets, and creasers for forming creases in the film at the corners of each bag.

17 Claims, 20 Drawing Figures

26
24
23
22
29
18
18
27
25
31
30
1
33
32
34
21
18
40
55
39
41
3
35
20
19
37
14
15
56
38
60
16
17
11
7
9
10
12
8
12
17
52
11
72
115
113
107
112
114
122
104
106
111
120
116
110
101
100
102
108
109
117
118
128
128
124
125
4
126
124
127
5

5
20
127
20
128
124
1
21
127
6

FIG. 6
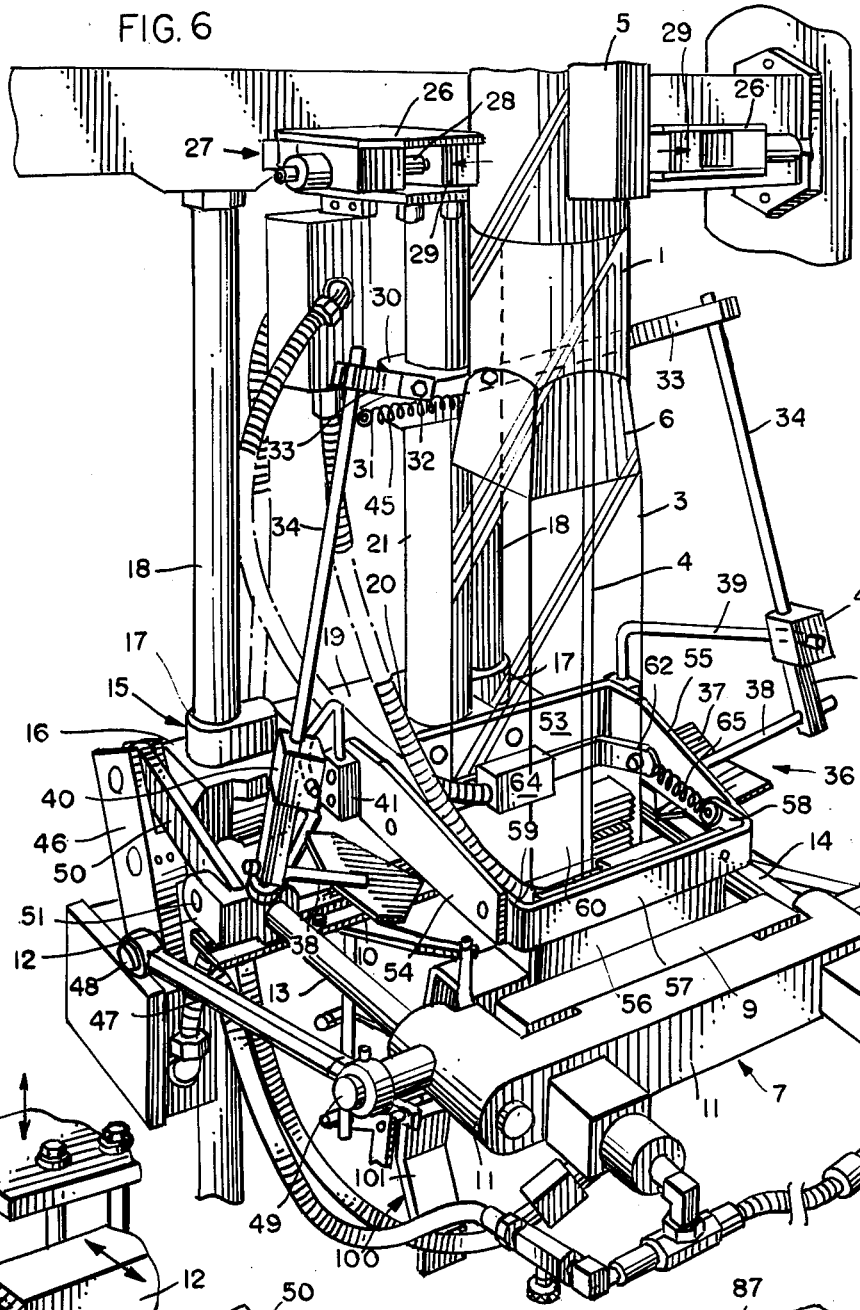
FIG. 7
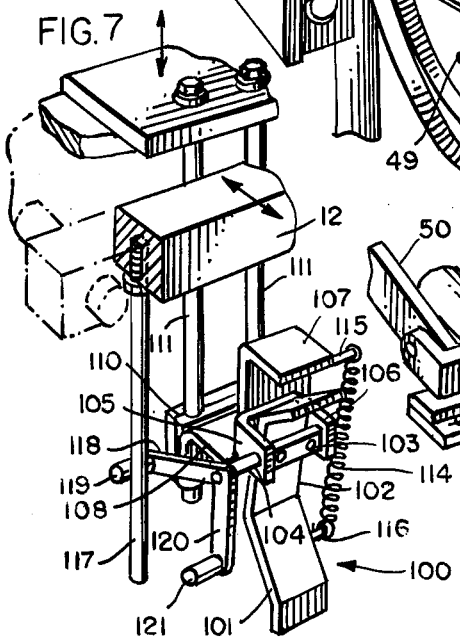
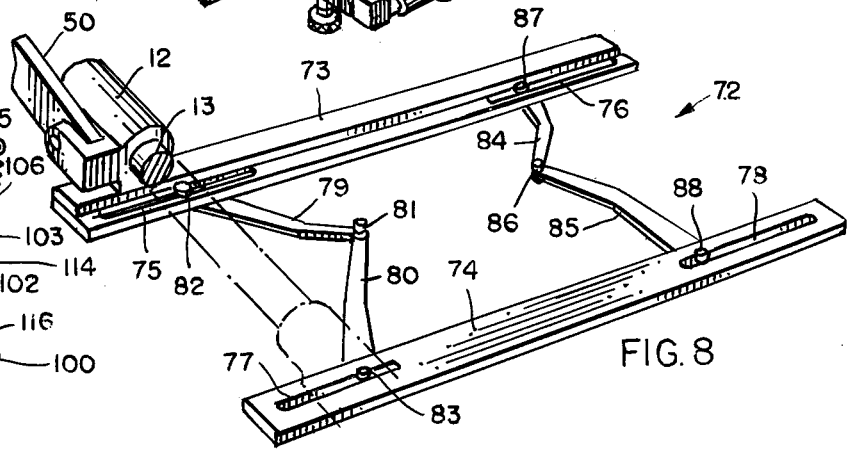
FIG. 8

BAG MAKING MACHINE

BACKGROUND OF THE INVENTION

Bag making machines wherein a heat sealable film is advanced over a forming shoulder and along a forming tube, and transversely sealed at spaced intervals to form bags have been known heretofore, but either the transverse sealing jaws have been used to advance the film, or other means have been used to advance the film while the sealing jaws remain stationary and do not move axially of the forming tube.

The use of separate means to advance the film has the advantage of relieving tension on the film, which is otherwise present when the sealing jaws are also used to advance the film. Furthermove, some films have a tendency to stretch if the sealing jaws are used for advancing the film. This, obviously, is a disadvantage from the standpoint of uniformity in the length of the bags being formed.

When means are used to advance the film which are independent of the sealing jaws, and when the jaws also move with the film while the film is advancing, but which do not themselves cause the film to advance, there results an elimination of film tension above the sealing jaws. This relaxed condition of the film allows low density product to more readily settle into the bottom of the bag. This is particularly true with respect to a pillow bag. This arrangement is further advantageous, however, in forming a flat bottom bag, since the relaxed condition of the film allows the flat bottom, which was formed at the top of the stroke, to be maintained while the film is being advanced and filled.

Also, flat bottom bags have been made heretofore, on machines which have used the principle of advancing the film by means of the sealing jaws, as shown for example in U.S. Pat. No. 3,552,081, and therefore were subject to the disadvantages mentioned above.

Friction belt means have also been used heretofore for advancing the film, such as shown, for example, in U.S. Pat. No. 3,826,061, but the sealing jaws did not move with the advancing film, and, therefore, this arrangement was likewise subject to the disadvantages referred to above.

These disadvantages have been overcome in the present invention, which enables the manufacture of flat bottom bags more rapidly than has heretofore been possible.

BRIEF SUMMARY OF THE INVENTION

The invention relates in general to a bag making machine wherein bags are made from a sealable film. The term "sealable", as used herein is intended to include film, the surfaces of which may be sealed together by the application of heat or pressure.

Bag making machines customarily are provided with a forming tube, at one end of which is a forming shoulder over which the film is fed and formed into a tubular shape around the forming tube. The film is advanced intermittently along the length of the forming tube through a distance which is substantially equal to the length of the bags to be formed, and a transverse seal is made by the use of sealing jaws which form the top of the leading bag and the bottom of the trailing bag next adjacent thereto. Most such bag making machines are vertical tube machines, but the forming tube can be disposed at other angles, or horizontally, if desired, depending upon the product which is to be placed in the bags. In these bag making machines, product is fed through the forming tube into the trailing bag, the bottom of which is being sealed, as the film is advanced. Since the present invention relates to the forming and sealing of the bag, the apparatus which is used to fill the bags with product has not been shown.

It is a principle object of the present invention to provide an improved bag making machine which is particularly adapted to make flat bottom bags.

Another object of the invention is to provide novel means for advancing the film along the length of the tube, which results in a relaxed condition of the film thereby improving the bag filling characteristics.

A further object of the invention is to provide means for advancing the film along the length of the forming tube which are independent of the transverse sealing jaws, but which move substantially simultaneously with the sealing jaws and at substantially the same rate of travel.

A still further and more specific object of the invention is to provide a novel arrangement of folding means to fold the tube of film inwardly from opposite sides in order to form a substantially flat bottom thereon.

Yet another and specific object of the invention is to provide a novel arrangement of tuckers for tucking the tubular film inwardly adjacent the flat bottom thereof to form gussets, and other tuckers for tucking the film inwardly adjacent the top of the formed bag.

A further object is to provide novel means for sealing the gussets so formed to the flat bottom of the bag, thereby to prevent product from entering the gussetted area, and to maintain the flat bottom.

Another object is to provide a novel support member for supporting the bottom of the filled bag as it is advanced away from the forming tube, and continues to support the bag until the tuckers are withdrawn from the gussetted area thereof and which also folds the cross seal fin of the bottom of the bag against the flat bottom thereof, this fin being the result of the severing of the leading bag from the film across the transverse seal at a point intermediate the upper and lower edges of the seal.

Other objects and advantages of the invention will appear more fully hereinafter as the description proceeds, reference being had to the accompanying drawings.

DESCRIPTION OF THE DRAWINGS

FIG. 6 is a fragmentary perspective view similar to FIG. 3, but showing the parts thereof in their inactive position;

FIG. 7 is a fragmentary perspective view similar to FIG. 4, but showing the support member in its inactive position;

FIG. 8 is a fragmentary perspective view similar to FIG. 5, but showing the tuckers for the top of the bag in their inactive position;

DETAILED DESCRIPTION OF THE INVENTION

Figure 1:
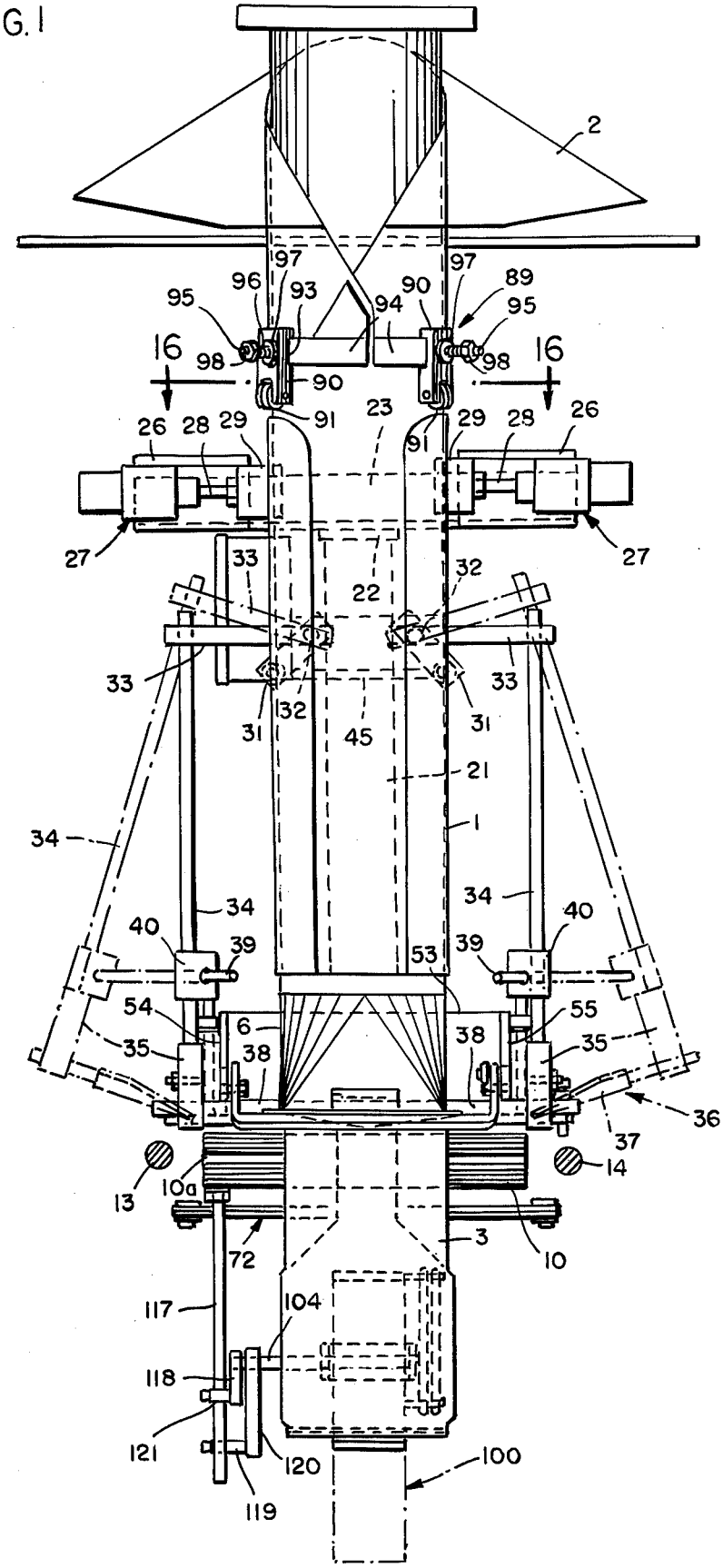
FIG. 1 is a front elevational view of that portion of the bag making machine which embodies the present invention, and showing the advancing grippers, the bottom folding plates and tuckers in actuated position, and with the front sealing jaw assembly omitted.

Referring now more particularly to the drawings, and especially to FIGS. 1 through 6, the forming tube, which is shown for purposes of illustration as being in a vertical position, is indicated by the numeral 1. The forming shoulder 2 is illustrated at the top of the forming tube, and the film 3 is fed by suitable and well known means over the forming shoulder and around the forming tube, so that the surface of the film adjacent the longitudinal edges of the film will be in a position to be sealed, such as by heat or pressure. For purposes of illustration herein, these longitudinal edges of the film are shown as being in overlapping relation, as at 4.

It will be evident that the surfaces of the film bordering the longitudinal edges thereof must be in contacting, sealable, relation, and may be positioned in overlapping relation as shown, or may have any other desired relationship such as, for example, where the inner surfaces of the film bordering the longitudinal edges thereof are in contact with each other to form a fin. A suitable form of back sealer 5 is provided for sealing together these surfaces of the film which border the longitudinal edges thereof. Although the means for advancing the film are novel, it will be understood that such means may be used whether of not the bag being formed is provided with a flat bottom. For the forming of flat bottom bags there is provided a rectangular bottom or outer end of the forming tube, which rectangular bottom is indicated in the drawings by the numeral 6.

Figures 2, 19, 20:
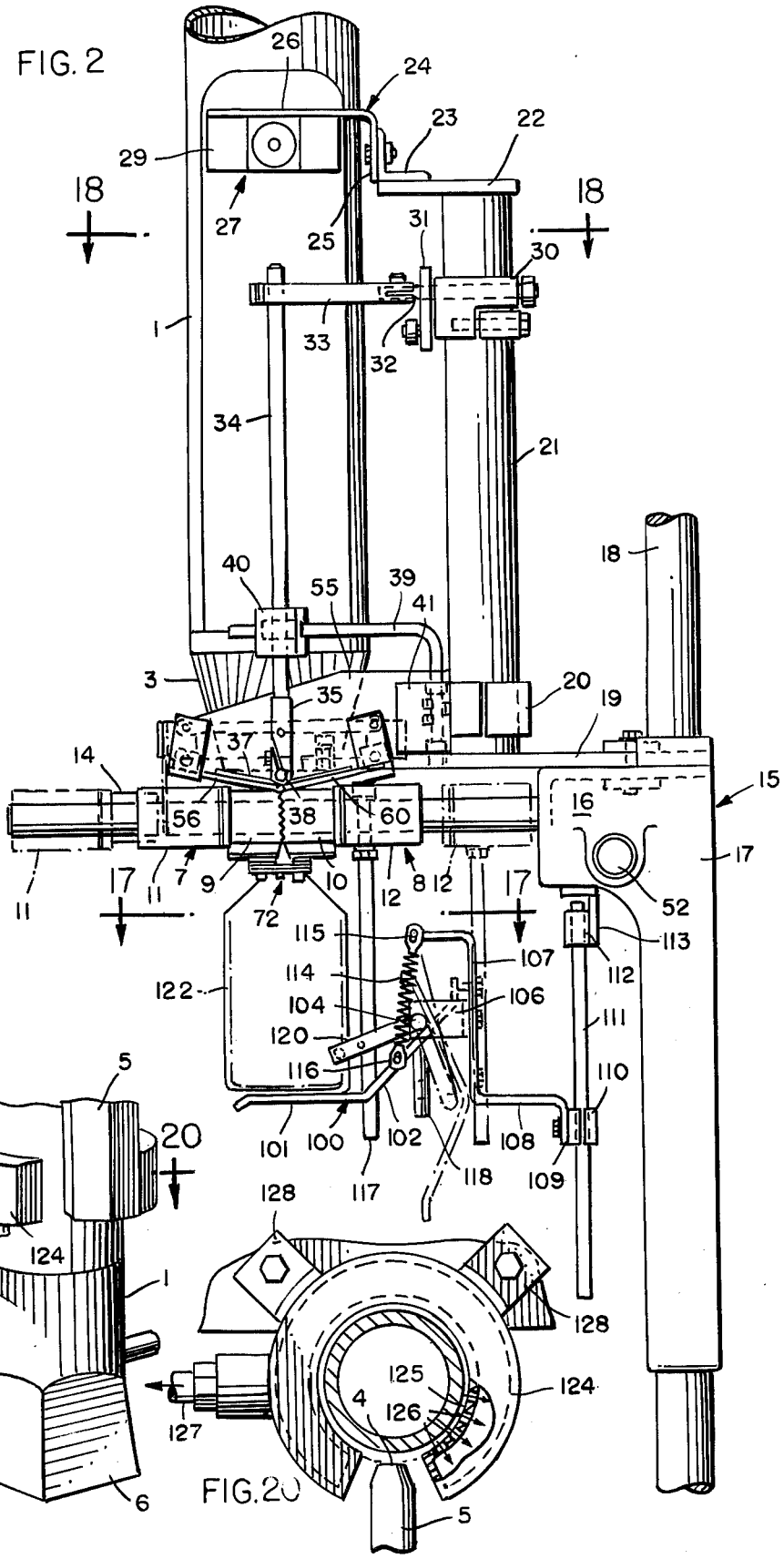
FIG. 2 is a side elevational view of the parts shown in FIG. 1 but with the corner creasers and forming shoulder omitted.
FIG. 19 is a fragmentary perspective view of a modified form of gripper means for advancing the film.
FIG. 20 is a horizontal plan view, partly in section, taken substantially along the plane of line 20—20 of FIG. 19.
Figure 3:
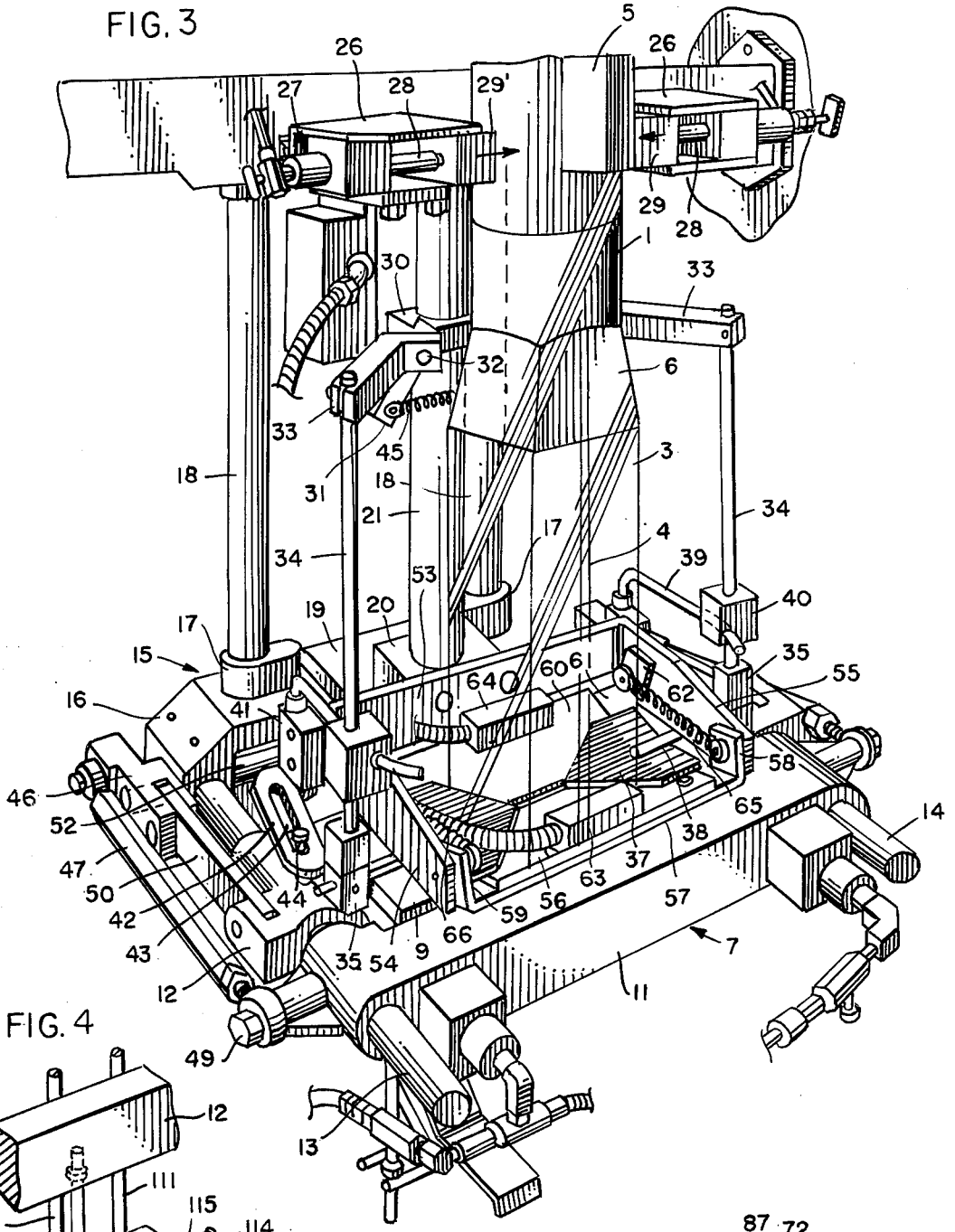
FIG. 3 is a fragmentary perspective view, on an enlarged scale, of that part of the machine embodying the present invention showing all of the parts in actuated position, as illustrated in FIG. 1.

The transverse sealing jaws for forming the transverse seal are illustrated more clearly in FIGS. 2, 3 and 6, wherein the front sealing jaw assembly is indicated generally by the numeral 7, and the rear sealing jaw assembly is indicated generally by the numeral 8. The front sealing jaw assembly is provided with a jaw member 9 having a serrated surface, and the rear sealing jaw assembly is provided with a similar serrated jaw member 10.

The front sealing jaw assembly, includes the slide frame 11 on which the sealing jaw is mounted, and the rear sealing jaw assembly 8 includes the slide frame 12 on which the rear sealing jaw 10 is mounted.

The front and rear sealing jaws reciprocate toward and away from each other, and for this purpose the jaws are mounted for sliding movement on the guide rods 13 and 14. The mechanism for actuating these sealing jaws will be described in greater detail hereinafter.

As mentioned heretofore, an important aspect of this invention is that means other than the sealing jaws are used to advance the film longitudinally of the forming tube. For this purpose suitable gripper means are provided which are caused to move substantially simultaneously with the sealing jaws, and to move axially with respect to the forming tube at substantially the same rate of travel as the sealing jaws. To accomplish this result there is provided a carriage on which both the sealing jaws and the gripper advancing means are mounted. This carriage is indicated generally by the numeral 15 and the construction thereof may be more clearly understood by reference to FIGS. 2, 3 and 6.

The carriage 15 is provided with a cross member 16 provided with journal members 17 adjacent each end thereof which receive the guide rods 18. These guide rods are rigid and the carriage is reciprocated along these rods which, in the drawings, are disposed in a vertical plane.

Support plate 19 is mounted on the cross member 16 between the journals 17, and extends forwardly of the guide rods 18. A mounting block 20 receives the support column 21 and is fixed thereto for movement therewith. Since the cross member 16, journals 17 and support plate 19 are all a part of the carriage 15 and reciprocate longitudinally of the guide rods 18, it follows that the mounting block 20, and support column 21 will also reciprocate as a part of the carriage.

At the top of column 21 there is provided a support plate 22 which extends forwardly thereof, and on which is mounted an elongated, transversely extending angle member 23. Two right angle support brackets 24 are secured to the angle member 23, one on each side of the forming tube. Each support bracket has a vertically extending leg 25 which is secured to the angle member, and a horizontally extending leg or plate 26. This structure may be seen in FIGS. 1, 3, and 6.

The Film Advancing Means

A cylinder and piston assembly 27 is mounted on the underside of each of the plates 26, the piston rod of each assembly being indicated by the numeral 28. The outer end of each piston rod 28 adjacent the forming tube has mounted thereon a gripper member 29. Such gripper member, in this particular form of the invention, has a relatively high friction surface on the side thereof adjacent the forming tube 1, and preferably is so shaped so that the entire surface thereof will engage the tubular film around the forming tube 1 when the piston is actuated to the gripping position thereof. Preferably this friction surface is resilient to obtain uniform contact and pressure.

These gripper members 29 comprise the means for advancing the film along the length of the forming tube.

It is evident from the foregoing description, that the gripper members will reciprocate axially of the forming tube with the carriage by reason of their mounting on the support column 21.

At a predetermined time during each cycle of the machine, fluid under pressure, such as air, will be admitted into the cylinder and piston assemblies to drive each of the piston rods 28 forwardly to a position where the friction surfaces thereon will engage the tubular film on the forming tube. This action will occur at the top of the stroke, so that, as the carriage moves downwardly the frictional engagement of the gripper members with the film, against the forming tube, will cause the film to advance until the carriage, and all other elements mounted thereon, reach the lowermost or advanced position thereof. It may be noted here that, to minimize the friction between the inner surface of the film and the outer surface of the forming tube, there is preferably provided a low friction surface on the forming tube.

When the carriage reaches its lowermost or advanced position, the lowermost bag will have been formed, filled and sealed, while the next bag thereabove and adjacent thereto will have been formed and filled. At this time the gripper members will be retracted, by reason of fluid pressure being admitted to the cylinder on the opposite side of the piston, and the carriage, and all elements mounted thereon, will be returned to its first or uppermost position.

The Bottom Tuckers

Referring again to FIGS. 2, 3, 6 and 18, there is illustrated the tucker members and the actuating means therefor. There are two tuckers, one on each side of the tubular film, and are caused to move inwardly toward each other to form gussets in the bottom of the bag, when a flat bottom bag is being formed. A mounting bracket 30 is clamped or otherwise secured onto the column 21 which supports the tucker members. Two lever arms 31 are provided, one for each tucker member, each of which is mounted on and secured to one of the spaced apart rods 32 which are mounted for rotative movement in the mounting bracket 30. Adjacent each of these lever arms 31, also mounted on the rods 32, there is provided a forwardly extending arm 33.

Each of these arms extend angularly and forwardly away from the mounting bracket in diverging relation, and at the outer end of each arm it is clamped or otherwise secured to an elongated downwardly extending rod 34. The lower end of each rod 34 is provided with a mounting block 35 which supports a tucker member generally indicated by the numeral 36.

Each tucker member 36 is preferably in the form of a plate 37, which is generally triangular in shape, and is provided with converging side edges. This shape of the plate on the tuckers has the advantage that, as they move inwardly toward each other, they will tuck the film inwardly adjacent the bottom of the bag and form a triangular-shaped gusset, which can be sealed to the flat bottom of the bag, and thereby maintain the flat bottom configuration.

Each of the tucker plates 37 is mounted on a rod 38 the outer end of which is received in the mounting block 35. Thus, as the arm 33 at each side of the forming tube is caused to pivot about its inner end, it will carry with it the rod 34 and the tucker members in a swinging movement from the outermost position thereof shown in FIG. 6, (and shown in phantom in FIGS. 1 and 18), to the innermost or actuated position shown in FIG. 3 (and in full lines in FIG. 18).

The actuating mechanism which causes these tucker members to move inwardly and outwardly includes a pivot rod 39, one for each tucker assembly, which has the outermost end thereof received within an opening in a floating block 40. Each rod 34 also is received within another opening in the same floating block 40, so that when a pivot rod 39 is moved inwardly and outwardly of the film, it will carry with it its associated rod 34 and the tucker assembly mounted thereon.

It will be evident that any suitable means may be provided to swing the pivot rod 39 back and forth, but since its action must be coordinated and timed with the opening and closing of the sealing jaws, this coordination can best be obtained by having the actuating means for the tuckers activated by movement of the sealing jaws.

For this purpose, the inner end of each pivot rod 39 is bent downwardly to extend through a mounting block 41 suitably positioned at each side of the forming tube so that the lower end thereof will extend therebelow. A slotted cam member 42 is mounted on the lower end of each of the pivot rods 39, as may be seen particularly in FIGS. 3 and 18. Each cam member 42 is provided with an elongated slot 43 which receives a cam roller 44 mounted on the rear slide frame 12.

Figure 18:
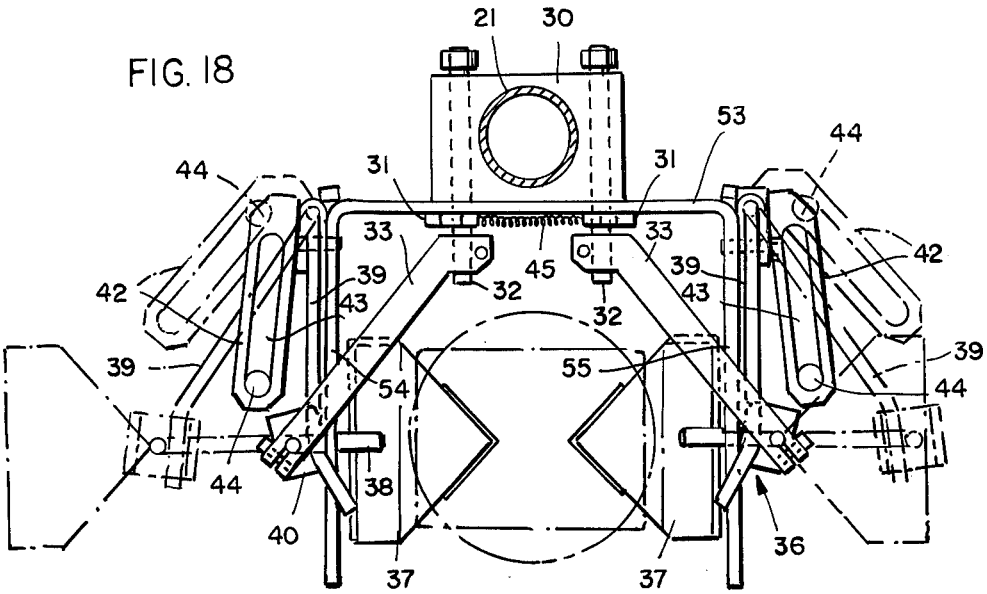
FIG. 18 is a top plan view, partly in section, showing the tuckers for forming the flat bottom of the bag in actuated position, and the actuating means therefore.

The action of these parts may be understood more clearly by referring to FIGS. 3, 6 and 18. For example, in FIG. 3, the sealing jaws are shown in closed position and the tucker members actuated to form the gusset at each side of the bag. It will be noted that the cam rollers 44 are at the forward end of the respective cam slots 43. This is also the position of the parts shown in full line in FIG. 18.

When the sealing jaws separate, and the rear jaw moves rearwardly, the cam rollers 44 will travel the length of the cam slots 43 to the rearmost end thereof as shown in phantom in FIG. 18. This action will cause each cam member 42 to move outwardly to rotate the lower end of rod 39 and pivot this rod 39 outwardly. In FIG. 18 this movement of the cam member will cause the downwardly extending end of pivot rod 39 on the left side to rotate in a clockwise direction, so that the forward end thereof will move outwardly and carry with it the floating block 40 and tucker member 36 associated therewith. At the other side of the machine, also as viewed in plan in FIG. 18, the rearward movement of the rear sealing jaw will cause the cam member 42 to move outwardly, thereby rotating the lower end of pivot rod 39 in a counter-clockwise direction and pivoting the horizontal portion of the rod 39 outwardly to its position shown in phantom in FIG. 18. This results in a withdrawal or outward movement of the tucker member associated therewith.

As may be seen in these same figures of the drawing, the lower ends of the lever arms 31 are connected by a spring 45. This applies torque on the pivot rods 32 and the arms 35 mounted thereon.

Operation of the Sealing Jaws

The sealing jaws are caused to reciprocate on the guide rods 13 and 14 toward and away from each other by means of an actuating lever 46 at each side of the machine. This lever is pivotally mounted for oscillating movement at substantially its longitudinal center and has one end of a link 47 connected to the lower end thereof (FIG. 6) by means of the pin 48. This link 47 extends forwardly and is connected at its forward end to a pin 49 on the front slide frame 11.

A second link 50 is secured to the upper end of the lever 46 (FIG. 6) and at its forward end is mounted on the rear slide frame 12 by means of a pivot pin 51.

The lever 46 is pivotally mounted intermediate the ends thereof on the actuating shaft 52. Suitable actuating means are provided for rotating the shaft 52 in an oscillating movement in timed relation with the other operating parts of the machine and the reciprocation of the carriage, so that as the shaft 52 and lever 46 are rotated in a clockwise direction, as viewed in FIGS. 3 and 6, to the position shown in FIG. 3, the link 50 will be carried forwardly so as to slide the rear slide frame and sealing jaw forwardly. At the same time, the lower end of lever 46 will move rearwardly, carrying the link 47 rearwardly, thereby moving the front slide frame 11 rearwardly by reason of the connection at 49 between the forward end of link 47 and the front slide frame.

In this position the sealing jaws are brought together to form a transverse seal in the film in a manner which is well-known to those skilled in the art. As will be noted hereinafter when reference is made to FIGS. 9 through 15, the sealing jaws will seal the film transversely thereof to form the top of the first or lowermost filled bag, and the bottom of the second bag immediately thereabove.

Also, as is well-known to those skilled in the art, the serrated face of each of the sealing jaws is provided with a longitudinal slot, one of which may be seen in FIG. 1 at 10*a*, so that a knife positioned in the slot of one jaw may be caused to move through the film and into the slot in the opposed jaw, thereby severing the lowermost filled and sealed bag from the film. Also, the sealing jaws are heated by well-known means to form the transverse seal, in the event that the film from which the bags are formed is a heat sealable film.

Thus far it will be evident that, at the top of the stroke of the carriage, the gripper members will be actuated to grip the film, the tucker members for forming the gussets in the bottom of the bag will be moved to their actuated gusset forming position, and the sealing jaws will move toward each other to form the transverse seal.

The Bottom Folding Plates

Additional means for forming the flat bottom on the bag and for sealing the formed gussets thereto, are also provided, and the operation thereof may be more clearly understood by reference to FIGS. 1, 2, 3 and 6. In these figures, there is shown a supporting yolk, the back plate 53 of which is secured to and mounted on the mounting block 20. The ends of this back plate are provided with the side arms 54 and 55 which extend forwardly thereof as shown. There are two bottom folding plates which are utilized, in conjunction with the tucker members, to form the flat bottom on the bag. One of these folding plates is indicated by the numeral 56 adjacent the front of the machine, which is mounted on a U-shaped bracket 57. The ends of this bracket extend inwardly to form the legs 58 and 59, which are pivoted to the side arms 54 and 55 adjacent the forward ends thereof. Thus, the bottom folding plate 56 is pivotally mounted for movement from its position shown in FIG. 6 to its position shown in FIG. 3 to fold the film inwardly and upwardly to form part of the bag bottom.

The other bottom folding plate 60 is pivotally mounted rearwardly of the folding plate 56, and is mounted on the U-shaped bracket 61 which is provided at its ends with the legs 62 pviotally mounted on the side arms 54 and 55 adjacent the rear thereof.

Both of these folding plates 56 and 60 are caused to move to their actuated position by the action of the sealing jaws moving toward each other. As the front sealing jaw 9 moves rearwardly it will contact the bottom folding plate 56, which is suspended downwardly from its pivots, to rotate it to its uppermost position. Likewise, the forward movement of the rear sealing jaw 10 will contact the folding plate 60 and rotate it upwardly to its actuated position. This actuated position of the folding plates may be seen not only in FIGS. 1, 2 and 3, but also in FIGS. 10 through 15, where they are shown diagrammatically.

The folding plates 56 and 60 are heated, when heat sealable film is used, for the purpose of sealing the gussets, formed by the tucker members, against the bottom of the bag. From the various views of the drawing it will be evident that the tuckers move inwardly to form the gussets, while the sealing jaws rotate the folding plates upwardly and move the film against the underside of the gussets formed by the tucker plates. Thus, the gussets formed by the tuckers will be in contact with the bottom of the bag formed by the folding plates, and the heat from such plates will seal the gussets and the bottom of the bag together. As mentioned above, this maintains the flat bottom on the bag and prevents the formation of pockets near the bottom of the bag into which product might otherwise find its way. To accomplish this result, the bottom folder 56 has mounted thereon a heating element 63, and the folding plate 60 has mounted thereon the heating element 64. These folding plates are urged downwardly to the inactive position thereof shown in FIG. 6 by means of the tension springs 65 and 66.

Figure 9:
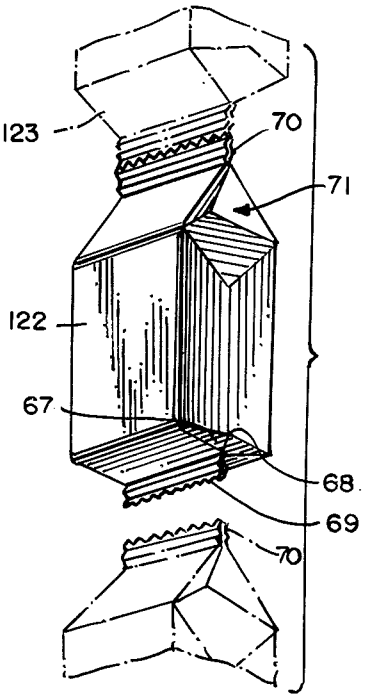
FIG. 9 is a diagrammatic illustration in perspective showing a formed, filled and sealed bag which has been severed from the film, with the next previously formed and filled bag adjacent thereto having become the leading bag still attached to the film, and showing the transverse seal forming the top of said leading bag and the bottom of the trailing bag adjacent thereto.

Referring for a moment to FIG. 9, the bottom tuck, formed by the bottom tuckers 37, is indicated by the numeral 67. The gusset, which is formed by such tuckers at each side of the bag, is at the bottom of each tuck 67, and is indicated at 68. These gussets are sealed to the bottom of the bag. FIG. 9 also shows a filled bag in phantom which has just been severed by the knife in the sealing jaws. This leaves a bottom fin 69 on the bag thereabove, and a top fin 70 on the severed bag.

The Top Tuckers

In addition to the bottom tuck 67, the flat bottom bag is also provided with an upper tuck, adjacent the top of the bag generally indicated by the numeral 71 and clearly illustrated in FIG. 9. The tucker members for forming the tuck 71 adjacent the top of each bag, are actually located in the machine below the tuckers 36 which form the tuck 67 in the bottom of the bag. Thus, simultaneously with the closing of the sealing jaws at the top of the stroke, when the carriage is in its uppermost position, and with the actuation of the tuckers 36 which form the tucks 67 in the bottom of the uppermost bag the tuckers for forming the tuck 71 will be actuated to form the tuck adjacent the top of the lowermost bag, which is at that time suspended below the sealing jaws.

Figure 5:
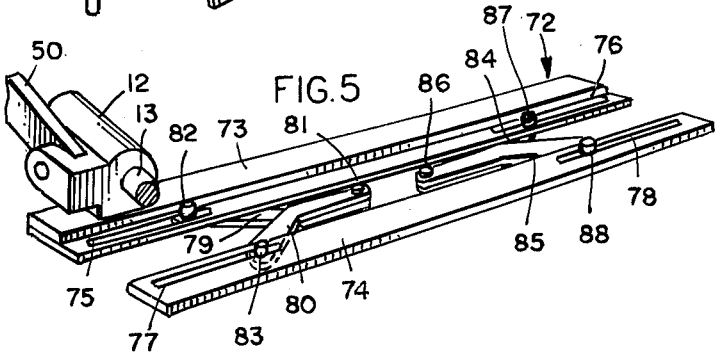
FIG. 5 is a fragmentary perspective view of the tucker members for tucking the film inwardly adjacent the sealed top of each bag, and shown in actuated position.

The tuckers for forming the tuck 71, and herein referred to as the "top tuckers", are indicated generally by the numeral 72 and are shown in FIG. 5 in their actuated position forming the tuck, and in FIG. 8 they are shown in their inactive position outwardly of the tubular film. This top tucker assembly may also be seen in end elevation in FIG. 2, and the rear part of this assembly may be seen in FIG. 1 of the drawings.

This top tucker assembly is mounted on the underside of the slide frames 11 and 12, and move with such slide frames when the sealing jaws are reciprocated toward and away from each other. The top tucker assembly 72 comprises the transversely extending support bars 73 and 74, the bar 73 being mounted on the underside of the rear slide frame 12, and the bar 74 being mounted on the underside of the front slide frame 11.

The rear supporting bar 73 is provided with the elongated slots 75 and 76 adjacent the ends thereof, and the front supporting bar 74 is provided with similar slots 77 and 78. One end of the tucker assembly is provided with the gusset forming fingers 79 and 80, the inner ends of which are pivotally mounted and secured together as at 81. The outer end of finger 79 is adjustably mounted for pivotal movement in the slot 75 by means of the pivot 82.

The outer end of finger 80 is likewise adjustably mounted for pivotal movement in the slot 77 by means of the pivot 83. These fingers 79 and 80 may be adjusted along the length of the slots 75 and 77 and then secured in place in their adjusted position by any suitable means.

Adjacent the opposite end of the tucker assembly 72 there is provided a similar arrangement of gusset forming fingers 84 and 85, which are similarly pivotally secured together at their inner ends by means of the pivot pin 86. The outer end of the finger 84 is adjustably mounted for pivotal movement in the slot 76, and the finger 85 is likewise adjustably mounted for pivotal movement in the slot 78. The pivot pin for the outer end of finger 84 is indicated at 87, and the pivot for the outer end of finger 85 is shown at 88.

It will be evident from viewing FIGS. 5 and 8, that the action of the top tuckers 72 is in the nature of a "lazy tongs" arrangement. When the two bars 73 and 74 are separated, the inner ends of the two sets of gusset forming fingers, 79 and 80 at one end and 84 and 85 at the other end, will be spread apart to their separated positions as shown in FIG. 8.

When the bars 73 and 74 are moved toward each other to their positions shown in FIG. 5, the inner pivoted ends 81 and 86 of the gusset forming fingers will move toward each other and thereby move the sides of the tubular film inwardly to tuck the film and form the gussets adjacent the top of the lowermost bag.

Since the bars 73 and 74 are mounted on the underside of the slide frames 12 and 11 respectively, and will move with the slide frames when the sealing jaws are moved to the sealing position thereof, and away from said position, it will be evident that, as the seal is being formed, the top tucks 71 will be formed in the lowermost bag which has been formed, filled and is at that time being sealed, simultaneously with the forming of the tucks 67 in the bottom of the uppermost bag immediately above the sealing jaws.

The Corner Creasers

Figure 16:
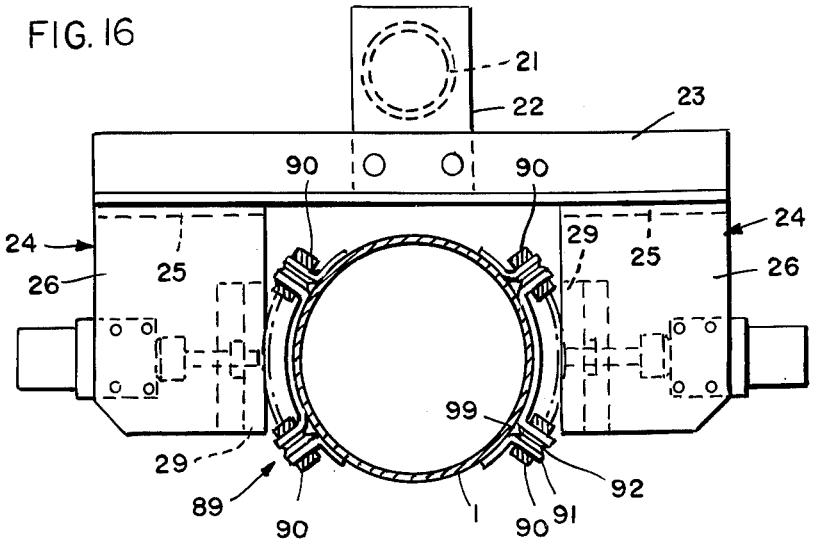
FIG. 16 is a horizontal sectional view taken substantially along the plane of line 16—16 of FIG. 1.

It has been found helpful in forming a flat bottom bag, which also has a substantially rectangular configuration, to provide means for forming a crease in the tubular film in substantial alignment with each of the corners of the rectangular lower end of the forming tube, so as to aid in forming the tubular film into a rectangular configuration. These corner creasers have been provided as a part of the present invention and the construction and operation thereof may be understood by viewing FIGS. 1 and 16. These corner creasers are indicated generally by the numeral 89, and it will be noted that there is provided one for each corner to be formed. Since all of these corner creasers are identical, a description of one will be sufficient. Each corner creaser comprises a creaser arm 90 positioned above the gripper assemblies 27, and are suitably spaced around the forming tube. The lower end of each creaser arm 90 is bifurcated to provide spaced legs between which there is rotatably mounted a roller 91. In the embodiment shown, each roller 91 is provided with an annular groove 92.

Adjacent the upper end of each creaser arm 90, on the inner surface thereof, there is provided a transversely extending recess or cut-out portion 93 which receives a mounting strip 94 welded, or otherwise affixed, to the outer surface of the forming tube.

Each creaser arm also is provided with an opening (not shown) through which a stud 95 extends. The inner end of this stud is secured to the mounting strip 94.

A compression spring 96 surrounds each of the studs 95 and bears at its inner end against a washer 97. The outer end of each spring 96 bears against an adjusting nut 98, whereby the pressure of the arm 90 and roller 91 against the film and the outer surface of the tube may be adjusted.

Also in the embodiment disclosed there is provided a creaser rail 99 mounted on the forming tube 1, for each of the rollers 91, and is so arranged as to be received in the adjacent groove 92 of such roller. Thus, as the tubular film is advanced along the length of the forming tube, a portion of the film will be advanced between the grooves 92 and the creaser rails 99, thereby forming a crease in the film itself.

It will be evident that specifically different arrangements may be provided for forming the corner creases in the film and still embody the inventive concept disclosed herein. For example, the groove and rail may be reversed so that the groove is on the inside of the film and the rail will be on the outside thereof. Also, the specific form of the rail and its associated groove may be modified to take other forms without departing from the inventive concept herein.

The Bottom Support And Sealing Fin Folder

The invention herein also encompasses a member which has a dual function, one of which is that of supporting the filled and sealed lowermost bag as the film is being advanced until the sealing jaws have separated and the lowermost bag has been severed from the film. The other function of this member is to fold the bottom sealing fin against the bottom of the bag. To understand the construction and operation of this supporting and sealing fin folder, reference will be made particularly to FIGS. 2, 4, 6 and 7, as well as to the diagrammatic FIGS. 10 through 15, and to FIG. 17.

In these figures the bottom support is indicated generally by the numeral 100. This consists of a plate which is provided with a horizontal portion 101 when in the bag supporting position, and which may be referred to as the bottom seal fold arm and support. The bottom sealing fin referred to herein is that which is indicated by the numeral 69 in the various figures which show the filled bag. At the time the lowermost bag is severed from the film the lowermost seal on the bottom of the bag results in the fin 69, while the uppermost seal at the top of the bag has the fin 70. It is more important that the lower seal 69 be folded over against the bottom of the bag in the completed condition thereof, so that the bag may stand upright on the bottom thereof.

Rearwardly of the support arm 101 the plate is bent upwardly to an angular position, as shown by the numeral 102. As may be seen more clearly by referring to FIGS. 4 and 7, the member 100 has secured thereto a transversely extending mounting block 103. A rick shaft 104 extends through the legs 105 and 106 of a U-shaped bracket, and through the mounting block 103, to which it is secured, so that when the shaft 104 is rocked in one direction it will move the support and folder plate 100 upwardly to the folding and supporting position thereof shown in FIG. 4. When the shaft 104 is rotated in the opposite direction, the various parts just mentioned will be rotated downwardly to the position shown in FIG. 7, so as to be out of the path of movement of the formed bag.

The U-shaped bracket, provided with the legs 105 and 106 through which the rock shaft 104 extends, is mounted on a support member 107, the configuration of which may be seen more clearly in FIG. 2. The upper part of this support is L-shaped, and adjacent the lower end thereof it is provided with a rearwardly bent portion 108 which terminates in a downwardly extending terminal portion 109. This portion 109 is secured to a mounting block 110, which is clamped or otherwise secured to a pair of vertically extending mounting rods 111. The upper ends of these rods has an upper mounting block 112 also clamped thereto, and this block is secured to a mounting plate 113 on the carriage 15.

Since the entire assembly associated with the bottom support and sealing fin folder 100 is thus mounted on the carriage, which reciprocates between the upper and lower positions thereof, it is evident that this bottom support and folder will also reciprocate therewith.

Figure 4:
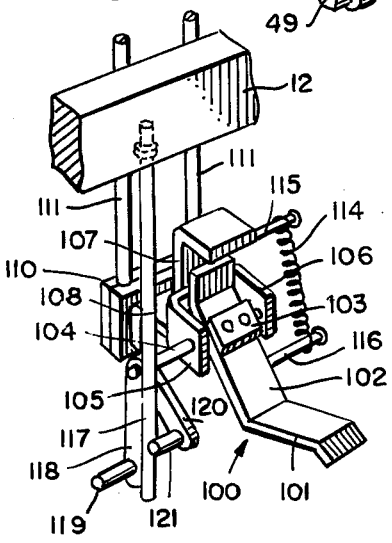
FIG. 4 is a fragmentary perspective view of the bottom support member in actuated position.

The actuating means for raising and lowering the supporting member 100 is so arranged that, as the sealing jaws move toward each other to form the uppermost seal on the lower bag and the lowermost seal on the upper bag, this member will move upwardly to the position shown in FIGS. 2 and 4. This assembly then remains in the bag supporting position thereof and will move downwardly with the carriage and all of the parts mounted thereon, until after the seal has been completed and the bottom bag severed from the film and the sealing jaws separate, at which time the support will return to the lower position thereof, thereby allowing the lower severed bag to drop downwardly to a suitable receptacle or conveyor for delivery away from the machine.

Figure 17:
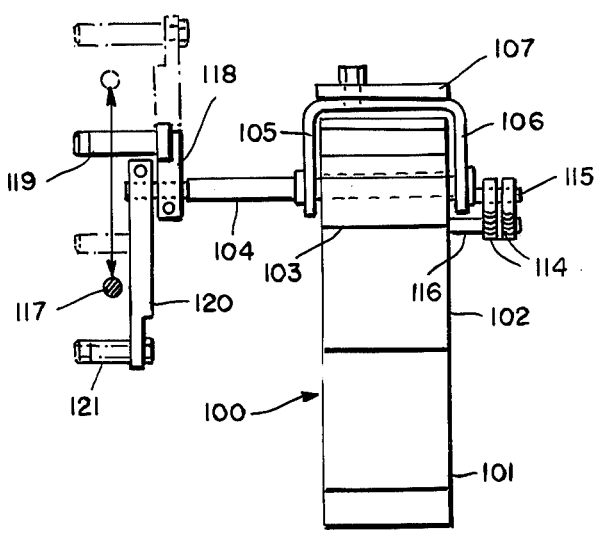
FIG. 17 is a top plan view of the bottom support member and the actuating means therefor taken substantially along the plane of line 17—17 of FIG. 2.

The actuating means for the support and folder 100 may be more clearly seen in FIGS. 4, 7 and 17. It will first be noted that tension springs 114 are provided to maintain the support member 100 in either its raised or lowered position. There may be one or more such springs, the upper ends of which are connected to an upper pin 115 extending outwardly from the support 107. The lower end of the spring is connected to a similar pin 116 on the support member 100 itself. These pins are so positioned relative to each other that when the support member is moved between its upper and lower positions, the springs 114 will move past dead center, thereby to yieldably hold the support in either of its two positions.

The actuating means for causing this movement of the bottom support and folder member 100 includes an actuating rod 117 which is secured at its upper end to the rear slide frame 12 and extends downwardly therefrom. A rear actuating arm 118 is mounted at one end thereof for rocking movement with the rock shaft 104, and is provided at its outer end with a roller 119. A front actuating arm 120 is also mounted at one end thereof on the rock shaft 104 and has at its outer end a roller 121.

Both of these rollers 119 and 121 extend outwardly into the path of movement of the rod 117, so that, when the sealing jaws open and the rear slide frame 12 moves rearwardly, it will carry with it the rod 117, which will thereupon be moved against the roller 119 and cause its associated arm 118, and the rock shaft 104, to rotate in a clockwise direction as viewed in FIGS. 4 and 7, thereby to move the bottom support and folder member 100 downwardly to its position shown in FIG. 7. When the sealing jaws close, the rear slide frame 12 will move forwardly and carry with it the rod 117 so that it will come against the roller 121, thereby rotating the arm 120 and rock shaft 104 in a counter-clockwise direction and moving the bottom support and folder 100 upwardly to its actuated position shown in FIG. 4. It will be evident that, when the actuating rod 117 contacts either of the rollers 119 or 121 to rotate the rock shaft, the springs 114 will be caused to move past dead center in one or the other directions and snap the bottom support and folder plate 100 to either of its extreme positions.

The filled bag is identified in the various figures of the drawings by the numeral 122 and may variously be referred to as the "first", or "lowermost" or "outermost" bag. The next adjacent bag above the first bag, which may also be referred to as the "second" bag, has been indicated in the various figures of the drawings by the numeral 123. This bag 123 has been provided with the bottom seal and bottom tuck, and may also be filled, depending upon the position of the bag in the cycle of the machine.

Alternative Gripper Means

The gripper means for advancing the film heretofore described, has been referred to as a friction arrangement, whereby high friction pads are mounted on the gripper jaws and low friction coverings are provided on the surface of the forming tube. An alternative form for accomplishing this same purpose of gripping the film and advancing it by means which are independent of the sealing jaws, are shown in FIGS. 19 and 20.

In these figures it is assumed that the vertical seal is formed by an overlapping relation between the edges of the film, as shown at 4, and which seal is formed by the back sealer 5. In this alternative form of gripper means, a vacuum is used which is applied to the outer surface of the film to pull the film against the inner surface of a vacuum chamber, thereby providing a different type of gripping means for the purpose of advancing the film.

FIGS. 19 and 20 illustrate an annular hollow chamber 124 which at least partially surrounds the forming tube, and which has in the inner surface 125 thereof a plurality of openings 126.

A vacuum conduit 127 is connected to a suitable source of vacuum (not shown) so that when a vacuum is pulled through the conduit 127 it will create a suction within the chamber 124 thereby to draw the film against the inner surface 125 of the chamber.

This vacuum chamber is suitably mounted, such as by the support brackets 128, on the column 21, so that the chamber will reciprocate with the carriage and advance the film in the same manner as heretofore described with respect to the first mentioned type of gripper means.

Operation

The operation of the individual elements which comprise the invention herein and which cooperate to form and seal the bag have been described hereinabove, but it may be helpful to an understanding of the complete operation of the machine to review these operations with particular reference to the diagrammatic illustrations of FIGS. 10 through 15.

Figure 10:
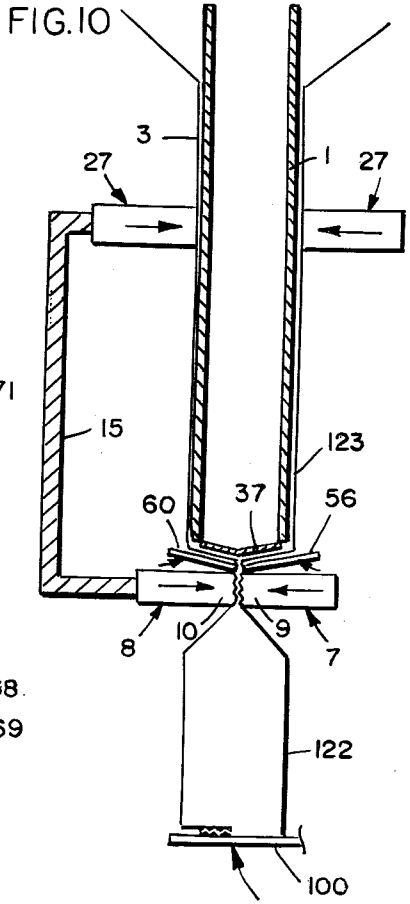

FIG. 10 shows the first or lowermost bag 122 having been formed and filled with the bottom seal thereon. It also shows all of the parts in their actuated position, wherein the sealing jaws 9 and 10, folding plates 56 and 60 and the bottom tuckers 37 have been brought together to perform their various functions as above described. The top tuckers 72 also will have been moved inwardly to form the top tuck 71 at this point in the operation, but these top tuckers have not been shown in these figures. The bottom support and fin folder member 100 has been moved upwardly to its bag supporting position. It will be noted in FIG. 10 that, with the raising of this element to support the bag, it also folds the lowermost sealing fin 69 upwardly against the bottom of the bag.

Figure 12:
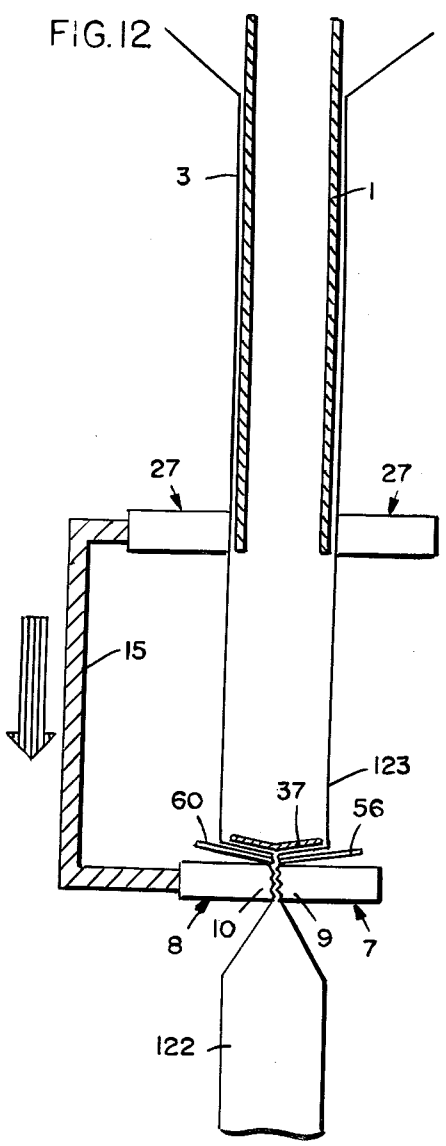
FIGS. 10–15 comprise a series of diagrammatic illustrations which show the sequence of steps which take place during the forming and sealing of a flat bottom bag according to the present invention.
Figure 11:
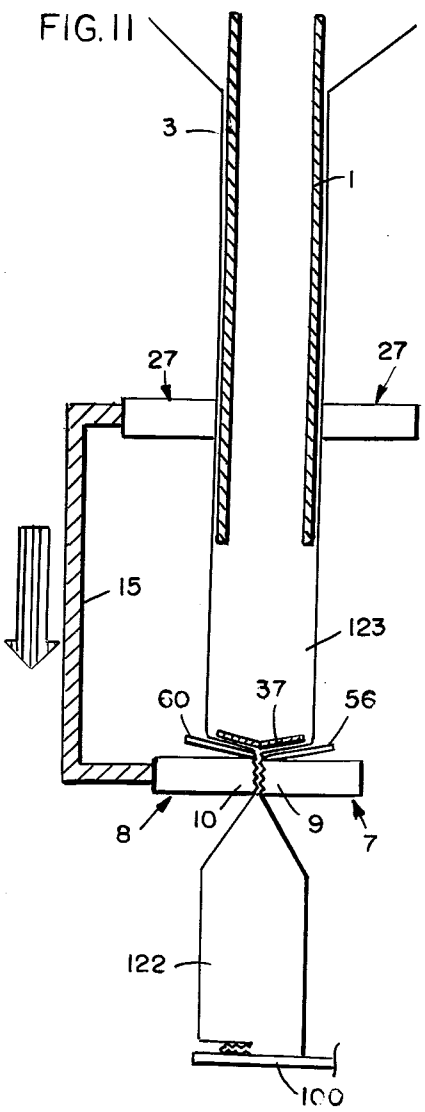

With all of the aforementioned parts in their actuated positions, including the gripper members 27, the carriage 15 moves downwardly through the positions shown in FIGS. 11 and 12, thereby advancing the first or filled bag 122 and the uppermost bag 123 adjacent thereto. During this movement, product will be fed into the partially formed bag 123, so that by the time it reaches the lower position of FIG. 12 the bag 123 will have received a predetermined quantity of product.

Figure 15:
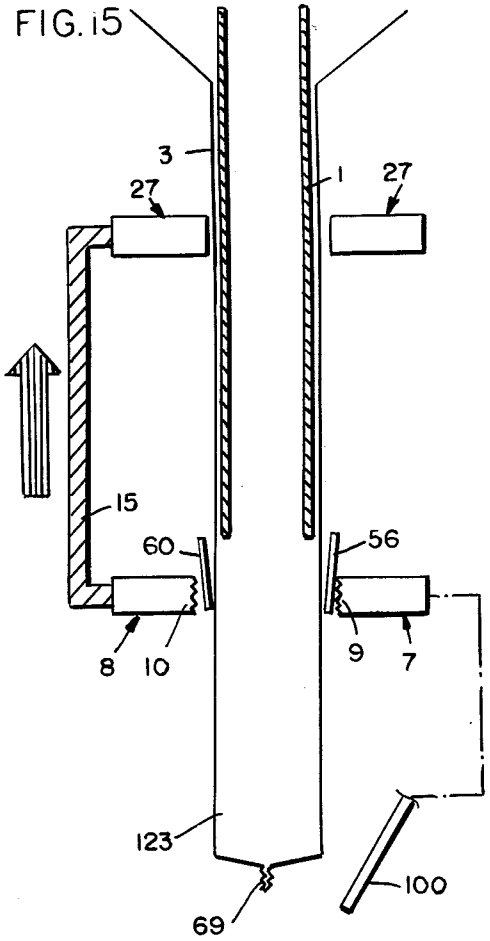
Figure 14:
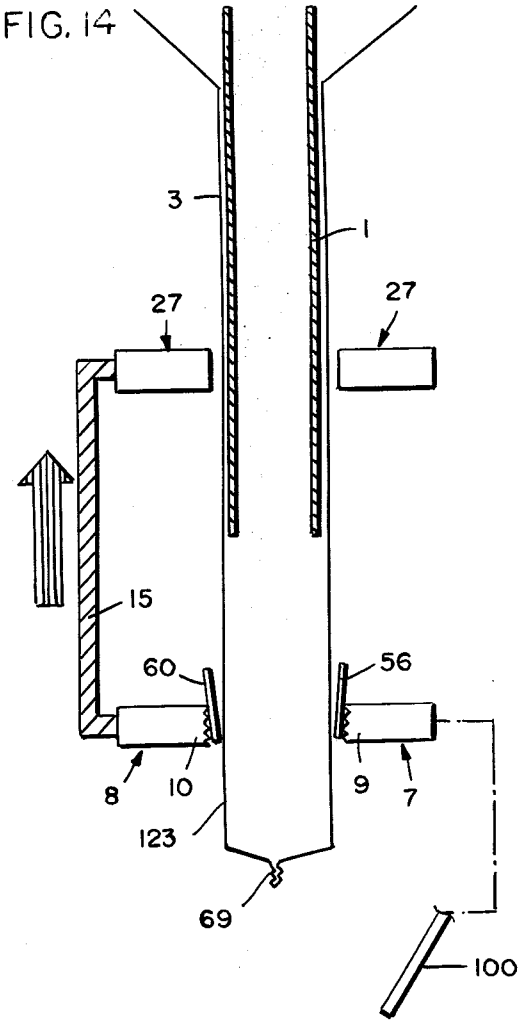
Figure 13:
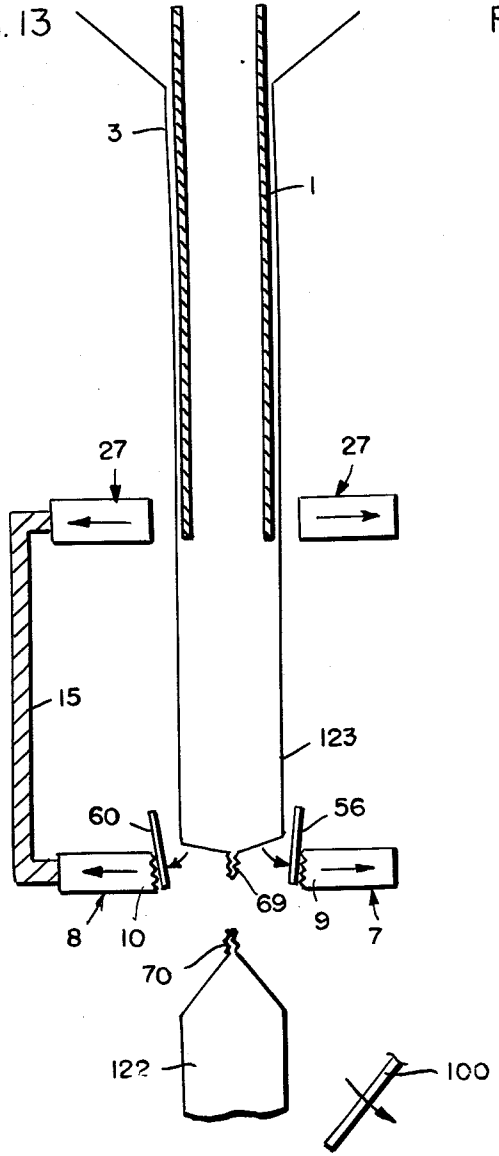

At this point the lowermost bag 122 will be severed from the film as heretofore described, and the sealing jaws will be separated as shown in FIG. 13. Separation of the jaws will allow the folding plates 56 and 60 to drop downwardly, and will likewise cause the bottom tuckers, as well as the top tuckers, to retract to their inactive positions. This movement of the jaws will also cause the bottom support and folder member 100 to move downwardly to its inactive position, and the gripper members 27 will likewise be withdrawn from their actuated positions. Thus, the lowermost bag will drop down and the entire assembly will begin movement upwardly or back to the initial position thereof as shown in FIG. 14. This movement will continue until the parts are in their positions as shown in FIG. 15 where the sealing jaws, folding plates, and tucker members are in their uppermost position immediately below the bottom of the forming tube. At this point all of the elements just described will be caused to be moved to their actuated positions as shown in FIG. 10 for the beginning of another cycle of the machine.

From the foregoing it will be evident that we have devised a novel bag making machine, which is particularly applicable to the forming of flat bottom bags in a novel and expeditious manner which has all of the advantages heretofore enumerated.

Changes may be made in the construction of the machine and the arrangement of parts from those described herein without departing from the spirit of the invention, provided however that such changes fall within the scope of the claims appended hereto.

We claim:

1. A bag making machine for making bags from a sealable film, comprising (a) a forming tube having a forming shoulder at one end thereof, (b) means for supplying a web of film to said tube over said shoulder to form said web of film into a tube with the surfaces bordering the longitudinal edges thereof in contacting sealable relation, (c) means for sealing said surfaces together (d) a pair of opposed sealer jaws for forming a seal transversely of said film to seal the trailing end of a first bag and the leading end of a second bag adjacent thereto, (e) means for moving said sealer jaws, while in sealing engagement with the film, from a first position thereof to a second position, and returning said jaws to the first position thereof while out of engagement with the film, (f) gripper means adjacent the outer surface of said forming tube and between the ends thereof for advancing the film along the length of said tube independently of said sealer jaws intermittently from a first position to a second position in a direction away from said forming shoulder substantially simultaneously with and at substantially the same rate of travel as said sealing jaws to provide sufficient length of film beyond the end of said forming tube to form a bag, and (g) means for severing the film to release said first bag therefrom.

2. A bag making machine as defined in claim 1, wherein said gripper means comprises friction means adapted to engage the film under pressure against said forming tube.

3. A bag making machine as defined in claim 1, wherein said gripper means comprises vacuum means adjacent the outer surface of said forming tube which holds the film against said means while advancing.

4. A bag making machine as defined in claim 1, including a carriage on which both said gripper means and said sealing means are mounted, and means for reciprocating said carriage longitudinally of said forming tube.

5. A bag making machine for making bags from a sealable film, comprising (a) a forming tube having a forming shoulder at one end thereof and a substantially rectangular configuration at the other end thereof.

(b) means for supplying a web of film to said tube over said shoulder to form said web of film into a tube with the surfaces bordering the longitudinal edges thereof in contacting sealable relation, (c) means for sealing said surfaces together, (d) means for advancing the film intermittently along the length of said tube away from said forming shoulder, (e) a pair of opposed sealing jaws for forming a seal transversely of said film to seal the trailing end of a first bag and the leading end of the innermost bag adjacent thereto, (f) a pair of opposed tucker members to tuck the film inwardly adjacent said other end of the forming tube prior to advancing the film, thereby to form gussets adjacent the bottom of said innermost bag, (g) a pair of folding plates disposed on opposite sides of said tube adapted to move toward each other and to fold inwardly the tubular film between said tuckers and said sealing jaws, thereby to form a substantially flat bottom on said innermost bag, and (h) means for severing the film to release the first bag therefrom.

6. A bag making machine as defined in claim 5, wherein said means for advancing the film includes, (a) gripper means adjacent the outer surface of said forming tube and between the ends thereof adapted to engage the film, and (b) means for moving said gripper means and the film, while in engagement therewith, lengthwise of said tube from a first position to a second position, and returning said gripper means to said first position while out of engagement with the film.

7. A bag making machine as defind in claim 5, including carriage means on which both said means for advancing the film and said sealer jaws are mounted, and means for reciprocating said carriage axially of said forming tube.

8. A bag making machine as defined in claim 5, including means for sealing said formed gussets to the flat bottom of the bag.

9. A bag making machine as defined in claim 5, wherein said folding plates are pivotally mounted, and means to pivot said plates inwardly against the film in forming the flat bottom thereon, thereby to minimize sliding of the film over the leading edges of said plates.

10. A bag making machine as defined in claim 5, including a second pair of opposed tucker means located outwardly of said sealer jaws and the side thereof opposite said first named tuckers, to tuck the film inwardly to form gussets in the first bag adjacent the top thereof.

11. A bag making machine as defined in claim 5, including support means movable against the flat bottom of the first bag and movable therewith axially of said forming tube as the said innermost bag is being formed.

12. A bag making machine as defined in claim 5, combined with creasing means for forming score lines in the film longitudinally thereof as it is advanced, in substantial alignment with the corners of the rectangular end of said forming tube.

13. A bag making machine as defined in claim 5, wherein said tucker members comprise plates, each of which has converging side edges.

14. A bag making machine as defined in claim 8, wherein said means for sealing said formed gussets comprises heating means to apply heat to said gussets as pressure is applied thereto between said folding plates and said tucker members.

15. A bag making machine as defind in claim 12, wherein said creasing means includes four grooved members on one side of the film, and four mating ribbed members on the opposite side of the film received by said grooved members and between which the film passes as it is being advanced.

16. A bag making machine for making bags from a sealable film, comprising (a) a substantially vertically positioned forming tube having a forming shoulder at the upper end thereof and a substantially rectangular configuration at the lower end thereof, (b) means for supplying a web of film to said tube over said shoulder to form said web of film into a tube with the surfaces bordering the longitudinal edges thereof in contacting sealable relation, (c) means for sealing said surfaces together, (d) a pair of opposed sealing jaws for forming a seal transversely of said film to seal the top end of the lowermost bag and the bottom end of the second bag thereabove and adjacent thereto, (e) means for moving said sealing jaws, while in sealing engagement with the film, from the uppermost position thereof to the lowermost position thereof, and returning said jaws to the uppermost position thereof while out of engagement with the film, (f) gripper means adjacent the outer surface of said forming tube and between the ends thereof for advancing the film downwardly along said tube independently of said sealing jaws intermittently from the uppermost position thereof to the lowermost position thereof substantially simultaneously with and at substantially the same rate of travel as said sealing jaws to provide sufficient length of film below the end of said tube to form a bag, (g) a pair of opposed tucker members to tuck the film inwardly adjacent the lower end of said forming tube prior to advancing the film, thereby to form gussets adjacent the bottom of said second bag, (h) a pair of folding plates disposed on opposite sides of said tube adapted to move toward each other and to fold inwardly the tubular film between said tuckers and said sealing jaws, thereby to form a substantially flat bottom on said second bag, and (i) means for severing the film between the upper and lower edges of the transverse seal, to release the lowermost bag therefrom, and thereby to leave a downwardly extending fin on the bottom of said second bag adjacent thereto.

17. A bag making machine as defined in claim 16, combined with support means movable against the bottom of said lowermost bag to fold into a substantially horizontal position the fin thereon formed by the immediately preceding severing operation, and movable downwardly therewith while the next succeeding bag is being formed.

* * * * *